US009546452B2

(12) United States Patent
Ikeshita et al.

(10) Patent No.: US 9,546,452 B2
(45) Date of Patent: Jan. 17, 2017

(54) PROCESS FOR MANUFACTURING PAPERBOARD

(71) Applicants: KATAYAMA CHEMICAL, INC., Osaka (JP); NALCO JAPAN G.K., Tokyo (JP)

(72) Inventors: Takahito Ikeshita, Osaka (JP); Yuji Fuchino, Osaka (JP); Hideaki Shimomoto, Osaka (JP); Hiroshi Hasegawa, Osaka (JP)

(73) Assignees: KATAYAMA CHEMICAL, INC., Osaka (JP); NALCO JAPAN G.K., Tokyo (JP)

( * ) Notice: Subject to any disclaimer, the term of this patent is extended or adjusted under 35 U.S.C. 154(b) by 0 days.

(21) Appl. No.: 14/407,677

(22) PCT Filed: Jun. 24, 2013

(86) PCT No.: PCT/JP2013/067240
§ 371 (c)(1),
(2) Date: Dec. 12, 2014

(87) PCT Pub. No.: WO2014/002945
PCT Pub. Date: Jan. 3, 2014

(65) Prior Publication Data

US 2015/0167248 A1 Jun. 18, 2015

(30) Foreign Application Priority Data

Jun. 25, 2012 (JP) ..... 2012-142053

(51) Int. Cl.

| | |
|---|---|
| ***D21H 21/20*** | (2006.01) |
| ***D21H 11/14*** | (2006.01) |
| ***D21H 17/07*** | (2006.01) |
| ***D21H 17/11*** | (2006.01) |
| ***D21H 17/66*** | (2006.01) |
| ***D21H 21/18*** | (2006.01) |
| ***D21H 17/37*** | (2006.01) |
| ***D21H 17/64*** | (2006.01) |
| ***D21H 17/00*** | (2006.01) |

(52) U.S. Cl.
CPC ..... *D21H 21/20* (2013.01); *D21H 11/14* (2013.01); *D21H 17/07* (2013.01); *D21H 17/11* (2013.01); *D21H 17/375* (2013.01); *D21H 17/64* (2013.01); *D21H 17/66* (2013.01); *D21H 17/74* (2013.01); *D21H 21/18* (2013.01)

(58) Field of Classification Search
CPC ..... D21H 21/18; D21H 21/20; D21H 17/11; D21H 17/375; D21H 11/14; D21H 17/66; D21H 17/07; D21H 17/64; D21H 17/74; D21H 21/04; D21H 21/36; D21H 21/10; D21C 5/02; A01N 59/00; A01N 33/18; A01N 33/14
See application file for complete search history.

(56) References Cited

U.S. PATENT DOCUMENTS

| | | | | | |
|---|---|---|---|---|---|
| 4,298,428 | A * | 11/1981 | Breslin | D21C 9/1036 | 162/72 |
| 4,940,514 | A * | 7/1990 | Stange | D21H 17/28 | 162/168.2 |
| 6,245,874 | B1 * | 6/2001 | Staib | C08F 220/56 | 162/158 |
| 7,008,545 | B2 * | 3/2006 | Cronan, Jr. | A01N 59/00 | 162/161 |
| 7,285,224 | B2 * | 10/2007 | Barak | A01N 59/00 | 162/161 |
| 7,651,622 | B2 * | 1/2010 | Barak | A01N 59/00 | 162/161 |
| 7,820,060 | B2 * | 10/2010 | Mayer | A01N 59/00 | 162/161 |
| 8,613,859 | B2 * | 12/2013 | Mayer | A01N 59/00 | 162/161 |
| 8,764,942 | B2 * | 7/2014 | Van Haute | D21H 21/36 | 162/147 |

(Continued)

FOREIGN PATENT DOCUMENTS

| | | | | |
|---|---|---|---|---|
| EP | 1734008 A2 * | 12/2006 | A01N 59/00 | |
| EP | 2865807 A1 * | 4/2015 | D21H 11/14 | |

(Continued)

OTHER PUBLICATIONS

JPO Machine Translation of JP 2005-290617, A published on Oct. 20, 2005.*

(Continued)

*Primary Examiner* — Jose Fortuna
(74) *Attorney, Agent, or Firm* — Greenblum & Bernstein, P.L.C.

(57) ABSTRACT

A method of producing a paper board comprising: a pulping step of disintegrating and beating fibers from a pulp raw material containing waste paper as a main raw material to obtain pulping process water; a stock preparation step of adding an additive containing a paper strength additive to the obtained pulping process water to obtain a prepared pulp raw material; and a paper-making step of making the obtained prepared pulp raw material into a paper board, wherein the paper board is produced by adding (a) an aqueous solution of hypochlorite and (b) an aqueous solution of water-soluble inorganic ammonium salt or ammonia water to the pulping process water to reduce the amount of the paper strength additive added in the stock preparation step.

4 Claims, No Drawings

(56) References Cited

U.S. PATENT DOCUMENTS

| | | | | |
|---|---|---|---|---|
| 8,999,112 | B2 * | 4/2015 | Faucher | D21H 17/375 162/158 |
| 9,091,024 | B2 * | 7/2015 | Van Haute | D21H 21/36 |
| 9,279,217 | B2 * | 3/2016 | Hietaniemi | D21H 27/002 |
| 2006/0231505 | A1 * | 10/2006 | Mayer | A01N 59/00 210/764 |
| 2008/0302497 | A1 * | 12/2008 | Storsberg | C08G 73/0206 162/164.6 |
| 2013/0319627 | A1 * | 12/2013 | Van Haute | D21H 21/36 162/161 |
| 2014/0242191 | A1 * | 8/2014 | Kolari | C02F 1/50 424/641 |
| 2014/0284011 | A1 * | 9/2014 | Krapsch | D21C 5/02 162/168.3 |
| 2015/0041092 | A1 * | 2/2015 | Hietaniemi | D21H 27/002 162/168.4 |
| 2015/0167248 | A1 * | 6/2015 | Ikeshita | D21H 11/14 162/168.3 |

FOREIGN PATENT DOCUMENTS

| | | | | | |
|---|---|---|---|---|---|
| JP | 200268910 | A | * | 3/2002 | A01N 43/80 |
| JP | 2003-105692 | A | | 4/2003 | |
| JP | 2005161254 | A | * | 6/2005 | C02F 1/50 |
| JP | 2005-290617 | A | | 10/2005 | |
| JP | 2007297318 | A | * | 11/2007 | A01N 33/12 |
| JP | 2008-43836 | A | | 2/2008 | |
| JP | 2010-84285 | A | | 4/2010 | |
| JP | 2010-100945 | A | | 5/2010 | |
| JP | 2011-226043 | A | | 11/2011 | |
| JP | 5621082 | B2 | * | 11/2014 | D21H 11/14 |
| JP | KR 20150024341 | A | * | 3/2015 | D21H 11/14 |
| WO | WO 2007025184 | A2 | * | 3/2007 | A01N 59/00 |
| WO | 2013/184605 | A1 | | 12/2013 | |
| WO | WO 2014002945 | A1 | * | 1/2014 | D21H 11/14 |
| WO | WO 2014030751 | A1 | * | 2/2014 | C02F 1/50 |

OTHER PUBLICATIONS

JPO Machine Translation of JP 2008-043836, A published on Feb. 28, 2008.*

JPO Machine Translation of JP 2010-100945 A, published on May 6, 2010.*

International Search Report for Patent Application No. PCT/JP2013/067240, mailed Sep. 24, 2013.

European Search report issued with respect to application No. 13808546.9 , mail date is Jan. 16, 2016.

* cited by examiner

PROCESS FOR MANUFACTURING PAPERBOARD

TECHNICAL FIELD

The present invention relates to a process for manufacturing a paperboard (a method of producing a paper board) using waste paper as a main raw material. In more details, the present invention relates to the method of producing a paper board, wherein a paper board such as a container board can be more economically produced by reducing an added amount of a paper strength additive by using waste paper as a main raw material.

BACKGROUND ART

In a paper board such as a container board, most of the raw material is comprised of waste paper.

In producing a paper board using waste paper as a main raw material, a paper board is produced through a pulping step of disintegrating and beating fibers from a pulp raw material with a pulper using waste paper as a main raw material to obtain a pulp slurry (also referred herein as "pulping process water") first; and then a stock preparation step of adding an additive containing a paper strength additive to the obtained pulping process water to obtain a prepared pulp raw material; and paper-making step of making the obtained prepared pulp raw material into a paper board. In the stock preparation step, a paper strength additive is added to the stock preparation water in order to keep the strength of the obtained paper board.

Waste paper contains a lot of starch from an adhesive or the like.

For this reason, Japanese Unexamined Patent Publication No. 2010-100945 proposes a method of producing the paper wherein the amylase activity, starch concentration, pH and oxidation reduction potential of the process water are continuously or intermittently measured and a bactericide is added due to the result of the measurement in order to prevent the degradation of starch in the pulping process water of waste paper on the assumption that the degradation of starch is caused by putrefaction due to the proliferation of microorganisms.

Japanese Unexamined Patent Publication No. 2011-226043 concludes, however, that the direct addition of a bactericide to the pulping process water of waste paper causes only partial disinfection with insufficient disinfection effect because of the poor dispersibility of the bactericide, the pulping process water having high pulp concentration not less than 3%. In other words, Patent document 2 concludes that the method of Patent document 1 cannot fully suppress the deterioration of the quality of the paper caused by microorganisms. Thus, Patent document 2 proposes a method of suppressing slime by adding a bactericide to diluent water for diluting the raw material in the process of producing the paper using waste paper or the like as raw material.

SUMMARY OF THE INVENTION

Problems to be Solved by the Invention

In the production of a paper board using waste paper as main raw material, the time required from the pulping step to the stock preparation step is one hour to several hours at most though depending upon a machine used. That is, even if starch or a paper strength additive from the waste paper exists on fibers, the possibility of the degradation due to the putrefaction of starch or a paper strength additive existing on the fibers in the course of flowing in is extremely low because the pulping process water smoothly flows into the stock preparation step in short time.

The production of a paper board using waste paper as main raw material requires, however, the addition of a large amount of a paper strength additive in the stock preparation step. It is believed that this is because starch and a paper strength additive existing on the fibers of waste paper are physically released in the course from the pulping step to the stock preparation step.

The present invention is directed to providing the method of producing a paper board, wherein a paper board such as a container board can be more economically produced by reducing an amount of a paper strength additive by using waste paper as main raw material.

Means for Solving to the Problems

The present inventors carried out intensive study by repeating trials and errors under expectation that if starch and a paper strength additive from waste paper are kept on fibers without being released in the pulping step, an added amount of paper strength additive can be reduced. As the result they have completed this invention by confirming in a practical process the fact that an added amount of paper strength additive can be remarkably reduced in the stock preparation step by adding an aqueous solution of hypochlorite such as aqueous sodium hypochlorite solution and an aqueous solution of water-soluble inorganic ammonium salt such as aqueous ammonium sulfate solution or ammonia water to the pulping process water in the process of producing a paper board using waste paper as main raw, material.

It is well known that the addition of aqueous sodium hypochlorite solution and ammonium sulfate to the paper producing process water gives a disinfection effect (for example, Japanese Patent No. 4914146).

It is believed, however, that the effect of reducing an amount of a paper strength additive in the stock preparation step is displayed due to another mechanism than the disinfection effect by the combined use of aqueous sodium hypochlorite solution and ammonium sulfate, from the low possibility of the degradation of starch and paper strength additive s from waste paper by putrefaction in a short time from the pulping step to the stock preparation step and the paper-making step, and from the fact that the direct addition of a bactericide to the pulping process water having a high pulp concentration of 3% or more displays an insufficient disinfection effect as pointed out by Patent document 2.

Thus, the present invention provides a method of producing a paper board comprising:

a pulping step of disintegrating and beating fibers from a pulp raw material containing waste paper as a main raw material to obtain pulping process water; a stock preparation step of adding an additive containing a paper strength additive to the obtained pulping process water to obtain a prepared pulp raw material; and a paper-making step of making the obtained prepared pulp raw material into a paper board, wherein the paper board is produced by adding (a) an aqueous solution of hypochlorite and (b) an aqueous solution of water-soluble inorganic ammonium salt or ammonia water to the pulping process water to reduce an amount of a paper strength additive added in the stock preparation step.

Effects of the Invention

The method of producing a paper board of the present invention can provides the method which is able to produce more economically a paper board such as a container board using waste paper as main raw material with an amount of a paper strength additive reduced.

In other words, the method of producing a paper board of the present invention can produce more economically a paper board, thus being industrially very useful, because it is able to reduce an amount of a paper strength additive in the stock preparation step by effectively utilizing (remaining) starch and a paper strength additive from a waste paper.

Reducible paper strength additive s include paper strength additives usable in producing a paper board, for example, publicly known paper strength additive s such as cationized starch, amphoteric starch, poly (vinyl alcohol), poly (acrylamide) based one, polyamide, epichlorohydrin based one.

The method of producing a paper board of the present invention further displays above-described effect in the following cases:

the case where the component (a) is an aqueous solution of sodium hypochlorite, potassium hypochlorite or calcium hypochlorite, and the component (b) is an aqueous solution of a water-soluble inorganic ammonium salt such as ammonium chloride, ammonium bromide, ammonium phosphate, ammonium dihydrogenphosphate, diammonium hydrogenphosphate, ammonium sulfate or ammonium nitrate or ammonia water;

the case where the pulping process water has a pulp concentration of 3 to 5%;

the case where the component (a) has an effective chlorine concentration of 1000-9000 mg/L, the component (b) has a concentration of 1000-9000 mg/L, and the component (a) and the component (b) are added to the pulping process water with a concentration of 1-40 mg/L converted to effective chlorine and with the molar ratio of 1:1 to 1.2 of effective chlorine in the component (a) to nitrogen in the component (b);

the case where a mixed solution is prepared by mixing the component (a) and the component (b), and then the obtained mixed solution is added to the pulping process water;

the case where a diluent water line flowing into the pulping process water is provided, and an component (a) addition point where the component (a) is added to diluent water in the diluent water line, and a component (b) addition point where the component (b) is added to diluent water in the diluent water line are set, and the component (a) is added at the component (a) addition point, and the component (b) is added at the component (b) addition point, respectively.

MODE FOR CARRYING OUT THE INVENTION

The method of producing a paper board of the present invention is the method of producing a paper board comprising:

a pulping step of disintegrating and beating fibers from a pulp raw material containing waste paper as a main raw material to obtain pulping process water; a stock preparation step of adding an additive containing a paper strength additive to the obtained pulping process water to obtain a prepared pulp raw material; and a paper-making step of making the obtained prepared pulp raw material into a paper board;

wherein the paper board is produced by adding (a) an aqueous solution of hypochlorite and (b) an aqueous solution of water-soluble inorganic ammonium salt or ammonia water to the pulping process water to reduce an amount of the paper strength additive added in the stock preparation step.

In the method of producing a paper board of the present invention, the component (a) and the component (b) are added to the pulping process water of the pulping step of obtaining the pulping process water by disintegrating and beating fibers from a pulp raw material containing waste paper as a main raw material, that is the pulping step of disintegrating and beating fibers from a pulp raw material such as waste paper as a main raw material using a pulper to obtain pulping process water, specifically the pulping step from a pulper, a pulper chest to a completion chest though depending on the type of a machine.

It is desirable for pulping process water to have a pulp concentration of 3 to 5%.

When the pulp concentration is in the above-mentioned range, the present invention can obtain an excellent effect more effectively.

The component (a) to be used in the present invention is not restricted unless it inhibits the effect of the present invention, including for example, an aqueous solution of hypochlorite such as sodium hypochlorite, potassium hypochlorite and calcium hypochlorite. The present invention can suitably use these aqueous solutions, particularly preferably an aqueous sodium hypochlorite solution among them.

The component (b) used in the present invention is not restricted unless it inhibits the effect of the present invention, including for example, an aqueous solution of a water-soluble inorganic ammonium salt such as ammonium chloride, ammonium bromide, ammonium phosphate, ammonium dihydrogenphosphate, diammonium hydrogenphosphate, ammonium sulfate and ammonium nitrate as well as ammonia water. The present invention can suitably use these aqueous solutions and ammonia water, particularly preferably aqueous ammonium chloride solution and aqueous ammonium sulfate solution among them.

The component (a) and the component (b) to be used in the present invention is not restricted unless they inhibit the effect of the present invention, and can be used as appropriate in a state of commercially available aqueous solution of them as it is or diluted with water or commercially compound dissolved in water.

For example, an aqueous sodium hypochlorite solution to be used in the present invention is not restricted unless it inhibits the effect of the present invention, a commercially available aqueous sodium hypochlorite solution with a concentration of 9 to 14% by weight being able to be suitably used.

An aqueous ammonium sulfate solution of the component (b) to be used in the present invention is not restricted unless it inhibits the effect of the present invention, commercially available ammonium sulfate dissolved in water as appropriate being able to be suitably used. Its concentration is, for example 10 to 40% by weight, preferably 10 to 35% by weight.

Further, an aqueous ammonium chloride solution of the component (b) to be used in the present invention is not restricted unless it inhibits the effect of the present invention, commercially available ammonium chloride diluted in water as appropriate being able to be suitably used. The concentration after diluted is, for example, 10 to 30% by weight.

In the method of producing a paper board of the present invention, the component (a) and the component (b) are added to the pulping process water wherein the component (a) has a concentration of 1000 to 9000 mg/L as an effective chlorine concentration, and the component (b) has a concentration of 1000 to 9000 mg/L, and the molar ratio of effective chlorine in the component (a) and nitrogen in the component (b) is 1:1 to 1:2. Although the added amount varies depending on the required amount of chlorine to be added in the pulping process water, the addition amount is preferably 1 to 40 mg/L converted to the effective chlorine concentration based on the pulping process water from the viewpoint of the effect of reducing an added amount of a paper strength additive in the stock preparation step.

More preferably, the component (a) has a concentration of 1000 to 3000 mg/L, and the component (b) had a concentration of 1000 to 3000 mg/L, and a molar ratio of effective chlorine in the component (a) and nitrogen in the component (b) is 1:1.1 to 1:1.6.

The preferable addition amount to the pulping process water is 1 to 20 mg/L converted the effective chlorine concentration.

A particular effective chlorine concentration of the component (a) is 1000, 1100, 1200, 1300, 1400, 1500, 1600, 1700, 1800, 1900, 2000, 2100, 2200, 2300, 2400, 2500, 2600, 2700, 2800, 2900, 3000, 3500, 4000, 4500, 5000, 5500, 6000, 6500, 7000, 7500, 8000, 8500, 9000 mg/L or the like.

The particular concentration of the component (b) is 1000, 1100, 1200, 1300, 1400, 1500, 1600, 1700, 1800, 1900, 2000, 2100, 2200, 2300, 2400, 2500, 2600, 2700, 2800, 2900, 3000, 3500, 4000, 4500, 5000, 5500, 6000, 6500, 7000, 7500, 8000, 8500, 9000 mg/L or the like.

The particular molar ratio of effective chlorine in the component (a) and nitrogen in the component (b) is 1:1.1, 1:1.2, 1:1.3, 1:1.4, 1:1.5, 1:1.6 or the like.

In the method of producing a paper board of the present invention, the component (a) and the component (b) are added to the pulping process water simultaneously or not at the same time. At that time, it is preferable embodiment to mix beforehand the component (a) and the component (b) in diluent water to prepare the mixed solution, and to add the obtained mixed solution to the pulping process water.

Although the order of adding the component (a) and the component (b) is not restricted, in order to obtain an excellent effect of the present invention efficiently, the component (a) and then the component (b) are preferably added in this order to the pulping process water. In the case where mixed solution is prepared beforehand also, it is preferable to add the component (a) and then the component (b) to the diluent water in this order.

Examples of continuously carrying out the above-mentioned embodiment include an embodiment wherein a diluent water line flows into the pulping process water, the component (a) addition point for adding the component (a) to the diluent water in the diluent water line and the component (b) addition point for adding the component (b) to the diluent water in the diluent water line are provided; and the component (a) is added at the component (a) addition point and the component (b) is added at the component (b) addition point, respectively. Thereby, the mixed solution of the component (a) and the component (b) is finally prepared in the diluent water line, and the obtained mixed solution flows into the pulping process water.

In the method of producing a paper board of the present invention, the component (a) and the component (b) are added to the pulping process water continuously or intermittently.

In order to reduce the cost of used agents, the concentrations of the component (a) and the component (b) may be reduced or they may be intermittently and less frequently added within a range in which the effect of the invention is not inhibited. For example, they are intermittently added for five minutes per hour as shown in an example.

In the above-described embodiment, in order to perform the treatment more effectively and surely, it is preferable to provide a chlorometer for measuring an effective chlorine concentration in the diluent water and a pH meter for measuring the pH of mixed solution of the component (a) and the component (b) in the diluent water line, and to adjust the addition amounts of the component (a) and the component (b) based on the result of their measurement.

In a case where the mixed solution of the component (a) and the component (b) is used in the method of producing a paper board of the present invention, the pH of mixed solution not less than eight is preferable from the viewpoint of the effect of reducing the amount of a paper strength additive added in the stock preparation step. If the pH of mixed solution is less than eight, it is preferable that the agent is added to the pulping process water after the pH of mixed solution is adjusted to eight or more by the addition of an alkaline agent such as sodium hydroxide and potassium hydroxide.

A prepared pulp raw material is obtained by adding an additive containing a paper strength additive to the pulping process water obtained in the pulping step as described above (stock preparation step), and a paper board is obtained by paper-making from the obtained prepared pulp raw material (paper-making step).

The stock preparation step and the paper-making step may be performed using a publicly known machine and method and setting a condition as appropriate. In the stock preparation step, in order to obtain a paper board having desired properties or physicality, an additive other than a paper strength additive may be added to the pulping process water in a suitable amount.

In a case where a paper board is produced from a pulp raw material containing waste paper as a main raw material, the addition amount of a paper strength additive can be reduced by 15 to 90% by weight according to the present invention compared with a conventional addition amount, though depending on components and their content contained in the pulp raw material and required properties for the produced paper board.

EXAMPLES

Although the present invention will be specifically explained by the following examples, the present invention is not restricted by these examples.

Example 1

The production of the linerboard was carried out using waste paper as a main raw material with the machine A of a certain paper board manufacturing factory producing 700 tons per day. Usually in this machine A, a poly (acrylamide) based paper strength additive is added continuously to the pulping process water in the amount of 0.75 kg/ton (based on weight of absolutely dried pulp) in the stock preparation step (Comparative example 1).

To the pulping process water in the pulping step of the above-mentioned machine A (broke pulper, pulp concentration 3.5%), a solution obtained by diluting 12% by weight aqueous solution of sodium hypochlorite (NaOCl) with industrial water 60 times (effective chlorine concentration: 2400 mg/L) was mixed with 35% by weight aqueous solution of ammonium sulfate ($(NH_4)_2SO_4$) so that the molar ratio of effective chlorine and nitrogen was 1:1.2 in the mixed solution. This solution was added to the pulping process water for five minutes every hour to adjust the concentration to 10 mg/L converted to effective chlorine, and the machine A was operated for 90 days to produce a linerboard.

In this case, however, an amount of poly (acrylamide) based paper strength additive added in the stock preparation step was reduced to 0.33 kg/ton (based on weight of absolutely dried pulp) from 0.75 kg/ton (based on weight of absolutely dried pulp) (56% reduced compared with the conventional operation).

The above mixed solution was prepared by providing a diluent water line flowing into the pulping process water, the component (a) addition point where sodium hypochlorite of the component (a) is added to the diluent water (industrial water) in the diluent water line and the component (b) addition point where ammonium sulfate of the component (b) is added, and by adding the component (a) and the component (b) at the component (a) addition point and the component (b) addition point respectively in this order so as to attain the above-mentioned condition.

Thus, a linerboard with an equal quality to that by the conventional operation condition (Comparative example 1) could be produced in spite of the reduction of the amount of a paper strength additive. The quality of the produced linerboard was confirmed to be equal to the conventional one on the basis of the ordinary standards of quality control such as bursting strength and ring crush.

The measurement of the COD of the wastewater from machine A (before activated sludge treatment) showed the reduction of COD from 550 mg/L in a conventional operation to 300 mg/L. It is considered from this result that the release of starch and a paper strength additive in a raw material waste paper from fibers was suppressed by adding the mixed solution of the present invention.

Example 2

The production of the linerboard and a corrugating medium by using waste paper as a main raw material was carried out using the machine B of a certain paper board manufacturing factory producing 470 ton per day. Usually in this machine B, a poly (acrylamide) based paper strength additive is added continuously to the pulping process water in 3.9 kg/ton (based on weight of absolutely dried pulp) in the stock preparation step (Comparative example 2).

To the pulping process water in the stock preparation pulping step of the above-mentioned machine B (completion chest, pulp concentration 4%), a solution obtained by diluting 12% by weight aqueous solution of sodium hypochlorite (NaOCl) with industrial water 60 times (effective chlorine concentration: 2400 mg/L) was mixed with a 35% by weight aqueous solution of ammonium sulfate ($(NH_4)_2SO_4$) so that the molar ratio of effective chlorine and nitrogen was 1:1.2 in the mixed solution. This solution was added to the pulping process water for five minutes every hour to adjust the concentration to 20 mg/L converted to effective chlorine, and the machine B was operated for 60 days to produce the linerboard.

In this case, however, the amount of poly (acrylamide) based paper strength additive added in the stock preparation step was reduced to 2.9 kg/ton (based on weight of absolutely dried pulp) from 3.9 kg/ton (based on weight of absolutely dried pulp) (25% reduced compared with the conventional operation).

The above mixed solution was prepared by providing a diluent water line flowing into the pulping process water, the component (a) addition point where sodium hypochlorite of the component (a) is added to the diluent water (industrial water) in the diluent water line and the component (b) addition point where ammonium sulfate of the component (b) is added, and by adding the component (a) and the component (b) at the component (a) addition point and the component (b) addition point respectively in this order so as to attain the above-mentioned condition.

Thus, the linerboard with an equal quality to that by the conventional operation condition (Comparative example 2) could be produced in spite of the reduction of the amount of a paper strength additive. The quality of the produced linerboard was confirmed to be equal to the conventional one on the basis of the ordinary standards of quality control such as bursting strength and ring crush.

The measurement of the COD of the wastewater from the machine A (before activated sludge treatment) showed the reduction of COD from 600 mg/L in the conventional operation to 350 mg/L. It is considered from this result, adding the mixed solution of the present invention suppressed the release of starch and a paper strength additive in a raw material waste paper from fibers.

Example 3

The following was carried out using the machine A of a certain paper board manufacturing factory in Example 1. Usually in the stock preparation step of this machine A, a poly (acrylamide) based paper strength additive is added continuously to the pulping process water in 0.75 kg/ton (based on weight of absolutely dried pulp) (Comparative example 3).

To the pulping process water in the pulping step of the above-mentioned machine A (broke pulper, pulp concentration 3.5%), a solution obtained by diluting 12% by weight aqueous solution of sodium hypochlorite (NaOCl) with industrial water 60 times (effective chlorine concentration: 2400 mg/L) was mixed with 20% by weight of aqueous solution of ammonium chloride ($NH_4Cl$) so that the molar ratio of effective chlorine and nitrogen was 1:1.2 in the mixed solution. This solution was added to the pulping process water for five minutes every hour to adjust the concentration to 10 mg/L converted to effective chlorine, and the machine A was operated for 90 days to produce the linerboard.

In this case, however, the added amount of poly (acrylamide) based paper strength additive in the stock preparation step was reduced to 0.33/ton (based on weight of absolutely dried pulp) from 0.75 kg/ton (based on weight of absolutely dried pulp) (56% reduced compared with the conventional operation).

The above mixed solution was prepared by providing a diluent water line flowing into the pulping process water, the component (a) addition point where sodium hypochlorite of the component (a) is added to the diluent water (industrial water) in the diluent water line and the component (b) addition point where ammonium chloride of the component (b) is added, and by adding the component (a) and the component (b) at the component (a) addition point and the component (b) addition point, respectively in this order so as to attain the above-mentioned condition.

Thus, a linerboard with an equal quality to that by the conventional operation condition (Comparative example 3) could be produced in spite of the reduction of the amount of a paper strength additive. The quality of the produced linerboard was confirmed to be equal to the conventional one on the basis of the ordinary standards of quality control such as bursting strength and ring crush.

The measurement of the COD of the wastewater from the machine A (before activated sludge treatment) showed the reduction of COD from 550 mg/L of a conventional operation to 300 mg/L. It is considered from this result that the release of starch and a paper strength additive in a raw material waste paper from fibers was suppressed by adding the mixed solution of the present invention.

According to the method of producing a paper board of the present invention, a paper board such as a container board can be more economically produced by reducing the amount of a paper strength additive using waste paper as a main raw material.

The invention claimed is:

1. A method of producing a paper board comprising:

disintegrating and beating fibers from a pulp raw material containing waste paper as a main raw material in water to obtain pulp slurry;

adding an additive containing a paper strength additive to the obtained pulp slurry to obtain a prepared pulp raw material; and making the obtained prepared pulp raw material into a paper board, wherein the paper board is produced by adding (a) an aqueous solution of hypochlorite and (b) an aqueous solution of water-soluble inorganic ammonium salt or ammonia water to the pulp slurry from a pulper to a completion chest to reduce an amount of the paper strength additive added while obtaining the prepared pulp raw material;

wherein the pulp slurry has a pulp concentration of 3 to 5%; and wherein the component (a) has a concentration of 1000 to 9000 mg/L as an effective chlorine concentration;

the component (b) has a concentration of 1000 to 9000 mg/L;

the component (a) and the component (b) in which a molar ratio of effective chlorine in the component (a) and nitrogen in the component (b) is 1:1 to 1:2 are added at 1 to 40 mg/L as converted in terms of effective chlorine concentration with respect to the pulp slurry; and said additives are added at any point between the pulper and the completion chest.

2. The method of producing the paper board according to claim 1, wherein the component (a) is an aqueous solution of hypochlorite of sodium hypochlorite, potassium hypochlorite or calcium hypochlorite, and the component (b) is an aqueous solution of water-soluble inorganic ammonium salt of ammonium chloride, ammonium bromide, ammonium phosphate, ammonium dihydrogenphosphate, diammonium hydrogenphosphate, ammonium sulfate or ammonium nitrate, or ammonia water.

3. The method of producing the paper board according to claim 1, wherein the component (a) and the component (b) are mixed to obtain a mixed solution, and the obtained mixed solution is added to the pulp slurry.

4. The method of producing the paper board according to claim 1, wherein a diluent water line that flows into the pulp slurry, a component (a) addition point for adding the component (a) to diluent water in the diluent water line, and a component (b) addition point for adding the component (b) to diluent water in the diluent water line are provided;

the component (a) is added at the component (a) addition point; and the component (b) is added at the component (b) addition point, respectively.

* * * * *